US010226853B2

(12) United States Patent
Bajaj et al.

(10) Patent No.: US 10,226,853 B2
(45) Date of Patent: Mar. 12, 2019

(54) METHODS AND APPARATUS FOR CONDITIONING OF CHEMICAL MECHANICAL POLISHING PADS

(71) Applicants: Rajeev Bajaj, Fremont, CA (US); Hung Chih Chen, Sunnyvale, CA (US)

(72) Inventors: Rajeev Bajaj, Fremont, CA (US); Hung Chih Chen, Sunnyvale, CA (US)

(73) Assignee: Applied Materials, Inc., Santa Clara, CA (US)

( * ) Notice: Subject to any disclaimer, the term of this patent is extended or adjusted under 35 U.S.C. 154(b) by 1330 days.

(21) Appl. No.: 13/801,127

(22) Filed: Mar. 13, 2013

(65) Prior Publication Data

US 2014/0206263 A1 Jul. 24, 2014

Related U.S. Application Data

(60) Provisional application No. 61/754,296, filed on Jan. 18, 2013, provisional application No. 61/757,817, filed on Jan. 29, 2013.

(51) Int. Cl.

| | |
|---|---|
| ***B24B 53/017*** | (2012.01) |
| ***B23K 26/38*** | (2014.01) |
| ***B24B 37/34*** | (2012.01) |

(52) U.S. Cl.

CPC ..... *B24B 53/017* (2013.01); *B24B 37/34* (2013.01)

(58) Field of Classification Search

CPC ..... B24B 49/00; B24B 49/12; B24B 53/001; B24B 53/017; B23K 26/38; B23K 26/367

USPC ..... 219/121.69; 451/5, 8, 22, 56, 72, 287, 451/443, 541

See application file for complete search history.

(56) References Cited

U.S. PATENT DOCUMENTS

| | | | | |
|---|---|---|---|---|
| 5,212,910 | A | 5/1993 | Breivogel et al. | |
| 5,489,233 | A | 2/1996 | Cook et al. | |
| 5,607,346 | A | 3/1997 | Wilson et al. | |
| 5,609,517 | A | 3/1997 | Lofaro | |
| 5,738,574 | A * | 4/1998 | Tolles et al. | 451/288 |
| 5,795,218 | A | 8/1998 | Doan et al. | |
| 5,893,976 | A | 4/1999 | Bauer | |
| 6,019,666 | A | 2/2000 | Roberts et al. | |
| 6,024,630 | A | 2/2000 | Shendon et al. | |
| 6,089,965 | A | 7/2000 | Otawa et al. | |
| 6,090,475 | A | 7/2000 | Robinson et al. | |
| 6,498,101 | B1 | 12/2002 | Wang | |

(Continued)

FOREIGN PATENT DOCUMENTS

| | | | |
|---|---|---|---|
| JP | 2001-009699 | A | 1/2001 |
| JP | 2001071256 | A | 3/2001 |

(Continued)

OTHER PUBLICATIONS

Machine translation of DOI, JP2001-071256, Mar. 21, 2001 Machine translation performed on Mar. 5, 2015 using AIPN.*

(Continued)

*Primary Examiner* — Brian W Jennison

(74) *Attorney, Agent, or Firm* — Patterson + Sheridan, LLP

(57) ABSTRACT

A method and apparatus for conditioning a polishing pad is provided. In one embodiment, a pad conditioning device for a substrate polishing process is provided. The pad conditioning device includes an optical device coupled to a portion of a polishing station adjacent a polishing pad, the optical device comprising a laser emitter adapted to emit a beam toward a polishing surface of the polishing pad, the beam having a wavelength range that is substantially non-reactive with a polishing fluid utilized in the polishing process, but is reactive with the polishing pad.

21 Claims, 6 Drawing Sheets

(56) References Cited

U.S. PATENT DOCUMENTS

| | | | |
|---|---|---|---|
| 6,612,916 | B2 | 9/2003 | Kollodge et al. |
| 6,794,605 | B2 | 9/2004 | Park et al. |
| 6,896,585 | B2 | 5/2005 | Tolles |
| 6,962,524 | B2 | 11/2005 | Butterfield et al. |
| 6,986,705 | B2 | 1/2006 | Preston et al. |
| 7,020,306 | B2 | 3/2006 | Hirose et al. |
| 7,192,340 | B2 | 3/2007 | Ono et al. |
| 7,258,600 | B1 | 8/2007 | Benner |
| 7,762,871 | B2 | 7/2010 | Bajaj |
| 8,398,463 | B2 | 3/2013 | Bajaj |
| 2001/0035354 | A1 | 11/2001 | Ashjaee et al. |
| 2001/0039175 | A1 | 11/2001 | Golzarian et al. |
| 2002/0016066 | A1 | 2/2002 | Birang et al. |
| 2002/0173255 | A1 | 11/2002 | Shendon et al. |
| 2003/0132120 | A1 | 7/2003 | Emesh et al. |
| 2003/0153245 | A1 | 8/2003 | Talieh et al. |
| 2003/0209528 | A1 | 11/2003 | Choo et al. |
| 2004/0110381 | A1 | 6/2004 | Yoshida |
| 2004/0166779 | A1 | 8/2004 | Balijepalli et al. |
| 2004/0232121 | A1 | 11/2004 | Park et al. |
| 2006/0079159 | A1 | 4/2006 | Naujok et al. |
| 2008/0016689 | A1 | 1/2008 | Horn et al. |
| 2008/0146119 | A1 | 6/2008 | Sasaki et al. |
| 2012/0107971 | A1 | 5/2012 | Birang et al. |
| 2012/0184194 | A1 | 7/2012 | Kim |

FOREIGN PATENT DOCUMENTS

| | | | |
|---|---|---|---|
| KR | 2011-0012293 | A | 2/2011 |
| TW | 541233 | B | 7/2003 |
| TW | 201143977 | A | 12/2011 |

OTHER PUBLICATIONS

PCT/US05/35660 filed Oct. 5, 2005, International Search Report and Written Opinion, dated Jun. 15, 2007, 8pp, International Searching Authority—US, Alexandria, Virginia.

PCT/US05/35979 filed Oct. 5, 2005; International Preliminary Report on Patentability; IPEA/US; dated Sep. 27, 2006; 7pp.

PCT/US05/35732 filed Oct. 5, 2005, International Search Report and Written Opinion, dated Nov. 28, 2006, 6pp, International Searching Authority—US, Alexandria, Virginia.

PCT/US05/35978 filed Oct. 5, 2005; International Preliminary Report on Patentability; WIPO; dated Jun. 7, 2007; 7pp.

PCT/US05/35978 filed Oct. 5, 2005, International Search Report and Written Opinion, dated Mar. 15, 2006, 10pp, International Searching Authority—US, Alexandria, Virginia.

PCT/US05/35979 filed Oct. 5, 2005, International Search Report and Written Opinion, dated Feb. 24, 2006, 8pp, International Searching Authority—US, Alexandria, Virginia.

PCT/US05/35732 filed Oct. 5, 2005; International Preliminary Report on Patentability; WIPO; dated Jun. 7, 2007; 5pp.

PCT/US05/35660 filed Oct. 5, 2005; International Preliminary Report on Patentability; WIPO; dated Jul. 19, 2007; 6pp.

PTC Notification of Transmittal of the International Search Report and the Written Opinion of the International Searching Authority for International Application No. PCT/US2013/065604 dated Feb. 17, 2014; 11 total pages.

Taiwan Search Report for Application No. 102138300 dated Mar. 1, 2017.

* cited by examiner

METHODS AND APPARATUS FOR CONDITIONING OF CHEMICAL MECHANICAL POLISHING PADS

CROSS-REFERENCE TO RELATED APPLICATIONS

This application claims benefit of U.S. Provisional Patent Application Ser. No. 61/754,296, filed Jan. 18, 2013, and U.S. Provisional Patent Application Ser. No. 61/757,817, filed Jan. 29, 2013, both of which are hereby incorporated by reference herein.

BACKGROUND

Field

Embodiments of the present invention generally relate to conditioning a polishing pad for polishing a substrate, such as a semiconductor wafer.

Description of the Related Art

In the fabrication of integrated circuits and other electronic devices on substrates, multiple layers of conductive, semiconductive, and dielectric materials are deposited on or removed from a feature side, i.e., a deposit receiving surface, of a substrate. As layers of materials are sequentially deposited and removed, the feature side of the substrate may become non-planar and require planarization and/or polishing. Planarization and polishing are procedures where previously deposited material is removed from the feature side of the substrate to form a generally even, planar or level surface. The procedures are useful in removing undesired surface topography and surface defects, such as rough surfaces, agglomerated materials, crystal lattice damage, and scratches. The procedures are also useful in forming features on a substrate by removing excess deposited material used to fill the features and to provide an even or level surface for subsequent deposition and processing.

During polishing processes, the polishing surface of the pad that is in contact with the feature side of the substrate experiences a deformation. The deformation includes smoothing of the polishing surface and/or unevenness in the plane of the polishing surface, as well as clogging or blockage of pores in the polishing surface that may lessen the ability of the pad to properly and efficiently remove material from the substrate. Periodic conditioning of the polishing surface is required to maintain a consistent roughness, porosity and/or a generally flat profile across the polishing surface.

One method to condition the polishing surface utilizes an abrasive conditioning disk that is urged against the polishing surface while being rotated and/or swept across the majority of the polishing surface. The abrasive portion of the conditioning disk, which may be diamond particles or other hard materials, typically cut into the pad surface, which forms grooves in, and otherwise roughens, the polishing surface. However, while the rotation and/or downforce applied to the conditioning disk is controlled, the abrasive portion may not cut into the polishing surface evenly, which creates a difference in roughness across the polishing surface. Fluid jet systems have been utilized to condition the polishing pad in lieu of abrasive disks, but these systems use great amounts of fluid and are expensive to operate. Other systems utilizing optical devices (e.g., lasers) that cut into the polishing surface have also been utilized. However, the optical energy interacts with polishing fluids on the pad, causing boiling of the fluid which may rupture pores in the polishing surface. With each of the aforementioned conditioning regimes, roughness across the polishing surface is not adequately controllable such that the roughness across the polishing surface is non-uniform. Additionally, as the cutting action is not readily controlled, the pad lifetime may be shortened. Further, the cutting action of these conditioning devices and systems sometimes produce large asperities in the polishing surface. While the asperities are beneficial in the polishing process, the asperities may break loose during polishing, which creates debris that may contribute to defects in the substrate.

Therefore, there is a need for a method and apparatus that facilitates uniform conditioning of the polishing surface of a polishing pad.

SUMMARY

A method and apparatus for conditioning a polishing pad is provided. In one embodiment, a pad conditioning device for a substrate polishing process is provided. The pad conditioning device includes an optical device coupled to a portion of a polishing station adjacent a polishing pad, the optical device comprising a laser emitter adapted to emit a beam toward a polishing surface of the polishing pad, the beam having a wavelength range that is substantially non-reactive with a polishing fluid utilized in the polishing process, but is reactive with the polishing pad.

In another embodiment, an apparatus for polishing a substrate is provided. The apparatus includes a conditioning device positioned adjacent the rotatable platen, the conditioning device adapted to emit and move an incident beam relative to a polishing surface of the polishing pad, wherein the conditioning device comprises an optical device, the optical device comprising a laser emitter adapted to emit a beam having a wavelength range that is not absorbed by a polishing fluid utilized on the polishing pad but is reactive with a material of the polishing pad.

In another embodiment, a method for conditioning a polishing pad is provided. The method includes rotating a polishing pad having a polishing fluid disposed thereon, and scanning the polishing pad with a laser beam having a wavelength that is substantially transparent to the polishing fluid.

BRIEF DESCRIPTION OF THE DRAWINGS

So that the manner in which the above-recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

To facilitate understanding, identical reference numerals have been used, where possible, to designate identical elements that are common to the figures. It is contemplated that elements disclosed in one embodiment may be beneficially utilized on other embodiments without specific recitation.

DETAILED DESCRIPTION

Figure 1:
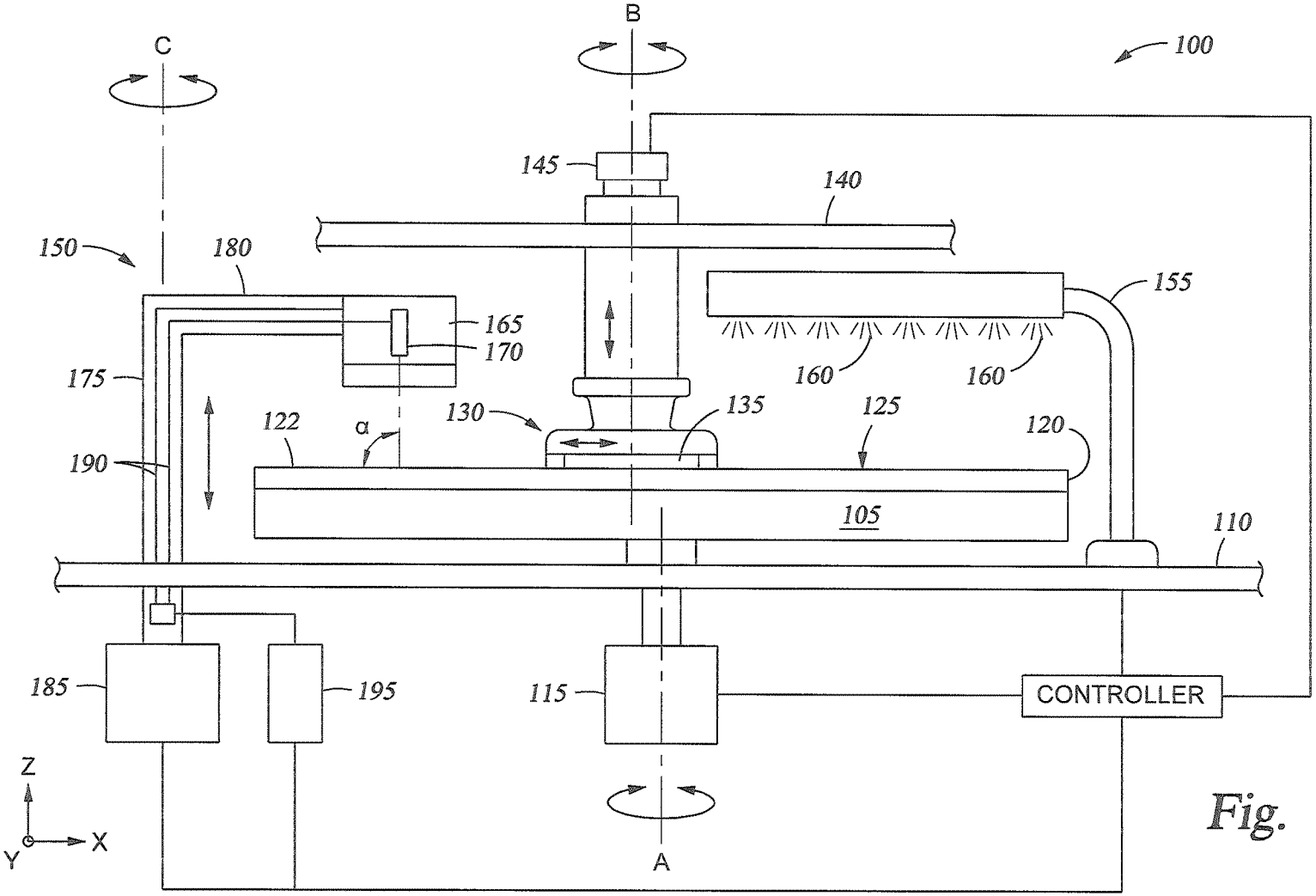
FIG. 1 is a partial sectional view of one embodiment of a processing station that is configured to perform a polishing process.

FIG. 1 is a partial sectional view of one embodiment of a processing station 100 that is configured to perform a polishing process, such as a chemical mechanical polishing (CMP) process or an electrochemical mechanical polishing (ECMP) process. The processing station 100 may be a stand-alone unit or part of a larger processing system. Examples of a larger processing system that the processing station 100 may be utilized with include REFLEXION®, REFLEXION® LK, REFLEXION® LK ECMP™, MIRRA MESA® polishing systems available from Applied Materials, Inc., located in Santa Clara, Calif., although other polishing systems may be utilized. Other polishing modules, including those that use other types of processing pads, belts, indexable web-type pads, or a combination thereof, and those that move a substrate relative to a polishing surface in a rotational, linear or other planar motion may also be adapted to benefit from embodiments described herein.

The processing station 100 includes a platen 105 rotatably supported on a base 110. The platen 105 is operably coupled to a drive motor 115 adapted to rotate the platen 105 about a rotational axis A. The platen 105 supports a polishing pad 120 having a body 122. The body 122 of the polishing pad 120 is a commercially available pad material, such as polymer based pad materials typically utilized in CMP processes. The polymer material may be a polyurethane, a polycarbonate, fluoropolymers, PTFE, PTFA, polyphenylene sulfide (PPS), or combinations thereof. The body 122 may further comprise open or closed cell foamed polymers, elastomers, felt, impregnated felt, plastics, and like materials compatible with the processing chemistries. While the body 122 may be dielectric, it is contemplated that polishing pads having at least partially conductive polishing surfaces may also benefit from the invention.

The polishing pad 120 comprises a processing surface 125 which includes a nap that may include microscopic pore structures. The nap and/or pore structures effect material removal from the feature side of a substrate. Attributes such as polishing compound retention, polishing or removal activity, and material and fluid transportation affect the removal rate. In order to facilitate optimal removal of material from the substrate, the processing surface 125 must be periodically conditioned to roughen and/or fully and evenly open the nap or pore structures. When the processing surface 125 is conditioned in this manner, the processing surface 125 provides a uniform and stable removal rate. The roughened processing surface 125 facilitates removal by enhancing pad surface wetability and dispersing polishing compounds, such as, for example, abrasive particles supplied from a polishing compound.

A carrier head 130 is disposed above the processing surface 125 of the polishing pad 120. The carrier head 130 retains a substrate 135 and controllably urges the substrate 135 towards the processing surface 125 (along the Z axis) of the polishing pad 120 during processing. The carrier head 130 is mounted to a support member 140 that supports the carrier head 130 and facilitates movement of the carrier head 130 relative to the polishing pad 120. The support member 140 may be coupled to the base 110 or mounted above the processing station 100 in a manner that suspends the carrier head 130 above the polishing pad 120. In one embodiment, the support member 140 is a circular track that is mounted above the processing station 100. The carrier head 130 is coupled to a drive system 145 that provides at least rotational movement of the carrier head 130 about a rotational axis B. The drive system 145 may additionally be configured to move the carrier head 130 along the support member 140 laterally (X and/or Y axes) relative to the polishing pad 120. In one embodiment, the drive system 145 moves the carrier head 130 vertically (Z axis) relative to the polishing pad 120 in addition to lateral movement. For example, the drive system 145 may be utilized to urge the substrate 135 towards the polishing pad 120 in addition to providing rotational and/or lateral movement of the substrate 135 relative to the polishing pad 120. The lateral movement of the carrier head 130 may be a linear, or an arcing or sweeping motion (shown as 215 in FIG. 2A).

A conditioning device 150 and a fluid applicator 155 are shown positioned over the processing surface 125 of the polishing pad 120. The fluid applicator 155 includes one or more nozzles 160 adapted to provide polishing fluids or a polishing compound to at least a portion of the radius of the polishing pad 120. The fluid may be a chemical solution, a cleaning solution, or a combination thereof, consisting primarily of water (e.g., about 70% to about 90%, or greater, content of de-ionized water (DIW)). For example, the fluid may be an abrasive containing or abrasive free polishing compound adapted to aid in removal of material from the feature side of the substrate 135. Reductants and oxidizing agents such as hydrogen peroxide may also be added to the fluid. Alternatively, the fluid may be a rinsing agent, such as DIW, which is used to rinse or flush polishing byproducts from the polishing material of the polishing pad 120.

The conditioning device 150 generally includes a conditioner head 165. The conditioner head 165 may comprise an optical device 170. The optical device 170 may be a laser emitter, a lens, a mirror, or other suitable device for emitting, transmitting, or directing a light beam toward the processing surface 125 of the polishing pad 120. The conditioner head 165 is coupled to a support member 175 by a support arm 180. The support member 175 is disposed through the base 110 of the processing station 100. Bearings (not shown) are provided between the base 110 and the support member 175 to facilitate rotation of the support member 175 about a rotational axis C relative to the base 110. An actuator 185 is coupled between the base 110 and the support member 175 to control the rotational orientation of the support member 175 about the rotational axis C to allow the conditioner head 165 to move in an arc or sweeping motion above the processing surface 125 of the polishing pad 120. The actuator 185 may also provide vertical positioning of the support member 175 (in the Z direction) to provide height control of the conditioner head 165 relative to the polishing pad 120.

In some embodiments, the actuator 185 may also be used to provide contact between the polishing pad 120 and the conditioner head 165, as well as urge the conditioner head 165 against the processing surface 125 of the polishing pad 120 with a controllable downforce. The support member 175 may house drive components to selectively control the vertical position (in the Z axis) and/or the angle α of one of the conditioner head 165 and the optical device 170 relative to the plane of the processing surface 125 of the polishing pad 120. The support member 175 and/or the support arm 180 may also contain signal members 190 that are coupled between a signal generator 195 and the optical device 170. The signal generator 195 may be a controllable power supply and the signal members 190 may be wires or optical fibers.

Figure 2A:
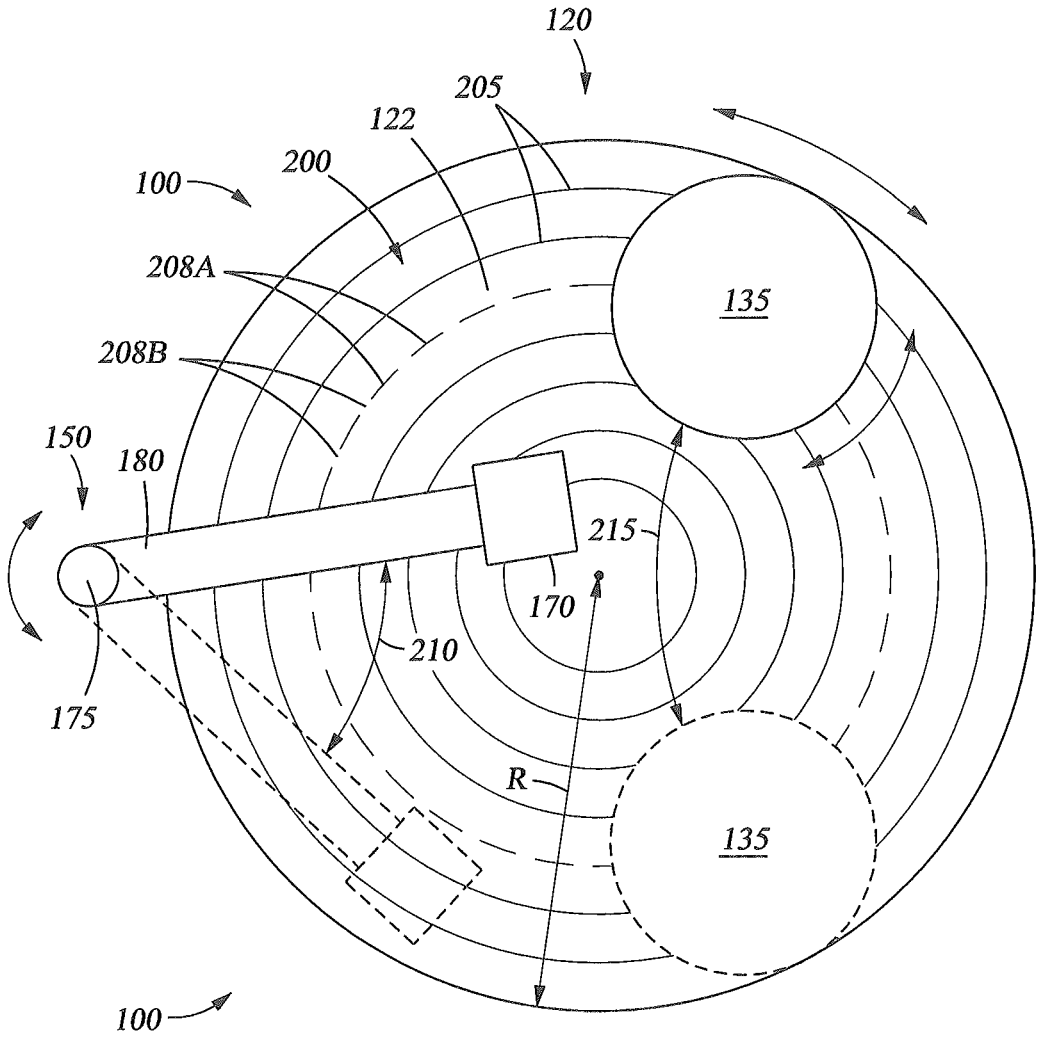
FIG. 2A is a top plan view of the processing station of FIG. 1.

FIG. 2A is a top plan view of the processing station 100 of FIG. 1. In one embodiment, the polishing pad 120 disposed in the processing station 100 includes a patterned processing surface 200 that facilitates removal of material from a substrate 135 and/or fluid transport during processing. The patterned processing surface 200 may be provided by the conditioning device 150 of FIG. 1. The patterned processing surface 200 may include grooves or channels, hereinafter referred to as marks 205 formed in the body 122 to a specific depth. Each of the marks 205 may comprise a fluid retaining structure formed the body 122 of the polishing pad 120 by the conditioning device 150. The marks 205 may be linear or curved, zig-zagged, and may have a radial, grid, spiral or circular orientation on the polishing pad 120. The marks 205 may be intersecting or non-intersecting. Alternatively or additionally, the processing surface 125 of the polishing pad 120 may be embossed.

In this embodiment, the patterned processing surface 200 includes a plurality of concentric marks 205. In some embodiments, the marks 205 may be intermittent to form discrete marks 208A separated by non-conditioned areas 208B of the processing surface 125 of the polishing pad 120 (e.g., areas of the processing surface 125 of the polishing pad 120 that are not conditioned by the optical device 170). Each of the marks 208A may be grooves, channels or holes that may comprise a fluid retaining structure formed the body 122 of the polishing pad 120 by the conditioning device 150. The marks 208A may also be linear or curved, zig-zagged, and may have a radial, grid, spiral or circular orientation on the polishing pad 120. FIG. 2A also shows the substrate 135 disposed on the processing surface 125 of the polishing pad 120 (partially in phantom) to indicate one embodiment of a polishing sweep pattern 215 of the substrate 135 on the patterned processing surface 200 during polishing.

Each of the marks 205 and/or marks 208A may be formed by continuous or intermittent pulsing of the signal generator 195 in order to provide a continuous or intermittent beam from the optical device 170 directed toward the processing surface 125 of the polishing pad 120. The marks 208A may define an array of holes or short, linear or curved channels in the processing surface 125 of the polishing pad 120 as shown in FIG. 2A. During polishing and/or conditioning, the polishing pad 120 may be rotated at about 0.5 revolutions per minute (rpm) to about 150 rpm. The support member 175 may be rotatable in order to move the optical device 170 disposed on the support arm 180 in a sweep pattern 210 across the processing surface 125 of the polishing pad 120. In one aspect, the rotational movement of the polishing pad 120 during processing is utilized in conjunction with the application of optical energy from the optical device 170 and/or the sweep pattern 210 to form the pattern of marks 205 and/or marks 208A on the processing surface 125 of the polishing pad 120. The pattern of marks 205 and/or marks 208A on the processing surface 125 of the polishing pad 120 may include a pitch of about 50 microns (μm) to about 1000 μm.

In one embodiment, at least a portion of the marks 205 and/or marks 208A formed in the processing surface 125 of the polishing pad 120 may include a width of about 50 μm to about 500 μm. The marks 205 and/or marks 208A formed in the processing surface 125 of the polishing pad 120 may include a depth of about 5 μm to about 250 μm, such as about 25 μm to about 125 μm. The width and/or depth of the marks 205 and/or marks 208A formed in the processing surface 125 of the polishing pad 120 may be maintained during the entire lifetime of the polishing pad 120 using the optical device 170. For example, the optical device 170 may be used to refresh the width and/or depth of the marks 205 and/or marks 208A during polishing processes, or in between polishing processes. In one embodiment, the optical device 170 is used to refresh the width and/or depth of the marks 205 and/or marks 208A between each substrate 135 that is polished on the polishing pad 120, such as after polishing a first substrate and before polishing a second substrate. In another embodiment, the optical device 170 is used to refresh the width and/or depth of the marks 205 and/or marks 208A, as necessary, which may be subsequent to a polishing process performed on more than one substrate 135 (e.g., two or more substrates).

Figure 2B:
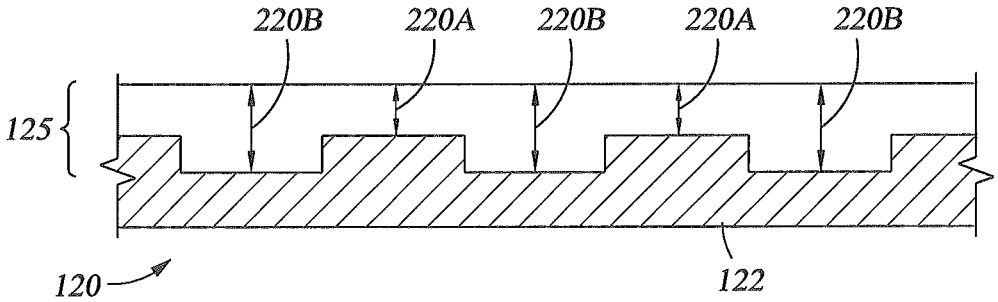
FIG. 2B is a cross-sectional view of a portion of a polishing pad.

FIG. 2B is a cross-sectional view of a portion of a polishing pad 120 showing a graded groove pattern in the processing surface 125. The graded groove pattern includes first grooves 220A and second grooves 220B that are formed by the optical device 170 at a non-uniform depth in the body 122. For example, when the optical device 170 is a laser device, the power may be pulsed between a low power setting to form the first grooves 220A at a first, shallower depth, and a high power setting to form the second grooves 220B at a second, deeper depth. The first grooves 220A and the second grooves 220B may be formed as a continuous groove in the processing surface 125, such as marks 205 shown in FIG. 2A. While not shown, the first grooves 220A and second grooves 220B may be formed in an array, such as marks 208A shown in FIG. 2A.

FIGS. 3-7 are side cross-sectional views of various embodiments of a conditioning device 150 shown in FIG. 1. Descriptions of common elements shown in FIGS. 1 and 3-7 will not be repeated for brevity.

Figure 3:
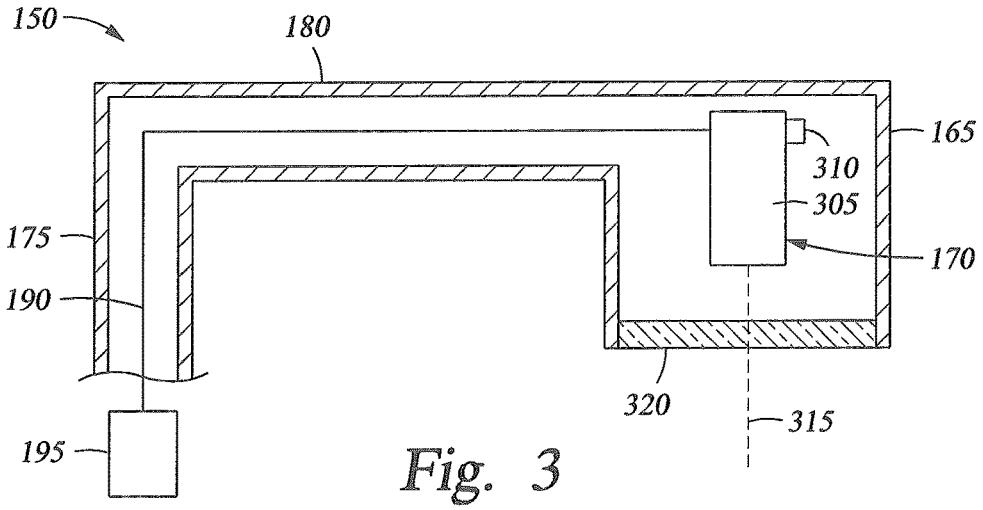
FIG. 3 is a schematic cross-sectional view of a conditioning device having one embodiment of an optical device disposed in the conditioner head.

FIG. 3 is a schematic cross-sectional view of a conditioning device 150 having an optical device 170 disposed in the conditioner head 165. The optical device 170 in this embodiment is a laser emitter 305. The laser emitter 305 may be fixed in the conditioner head 165 or be adapted to move relative to the conditioner head 165 by an actuator 310. The actuator 310 may be fixed between the conditioner head 165 and the laser emitter 305. The actuator 310 may be servo or stepper motor, pneumatic cylinder, solenoid, and the like, that is adapted to move the laser emitter 305 vertically, laterally, at an angular relationship to the plane of the processing surface 125 of the polishing pad 120, and combinations thereof.

The laser emitter 305 is adapted to emit a continuous or pulsed primary beam 315 against the polishing pad 120 (similar to the embodiment shown in FIG. 1) to form groove patterns as shown and described in FIGS. 2A and 2B. In one aspect, the primary beam 315 is provided in a wavelength range that is absorbed by polishing pad material in preference to the polishing fluid utilized in the polishing process in order to form mark and/or groove patterns shown and described in FIGS. 2A and 2B. In another aspect, the primary beam 315 is provided in a wavelength range that is substantially non-reactive with a polishing fluid utilized in the polishing process, but is reactive with the polishing pad material, in order to form groove patterns shown and described in FIGS. 2A and 2B.

"Substantially non-reactive" may be defined as the incapability of the beam to cause a phase change of the polishing fluid under normal operating conditions (i.e., wavelength range of the beam, output power of the beam, spot size of the beam, dwell time of the beam on the polishing pad material, and combinations thereof). "Substantially non-reactive" may also be defined as the incapability of the beam to cause the polishing fluid to heat up and/or boil under normal use in the conditioning process as described herein. For example, the wavelengths of the laser emitter 305 as described herein would not cause a substantial rise in temperature of the polishing fluid under normal operating conditions using a pulsed beam and/or short dwell times.

The output power of the laser emitter 305 may be about 2 Watts (W) to about 20 W, or greater, and configured to produce a beam having a spot size of about 25 μm to about 250 μm on the processing surface 125 of the polishing pad 120. A window 320 may be coupled to the conditioner head 165 in the path of the primary beam 315 to prevent debris from the conditioning process to contact the laser emitter 305 and/or the interior of the conditioner head 165. The window 320 may be transparent to the primary beam 315 or be configured as a filter that may attenuate light outside of specific wavelengths.

The laser emitter 305 may be stationary or the laser emitter 305 may be moved by the actuator 310 to scan the primary beam 315 at a speed of about 1.5 centimeters per second (cm/sec) to about 500 cm/sec. In one embodiment, the laser emitter 305 may be moved by the actuator 310 to scan the primary beam 315 at a speed of about 50 millimeters per second (mm/sec) to about 1,500 mm/sec. For example a 3 W, 355 nm wavelength laser beam with an 80 μm spot size may create a mark (e.g., groove or hole) having a depth of about 80 μm at scan speed of about 50 millimeters per second (mm/sec). In another example, a 3 W, 355 nm wavelength laser beam with an 80 μm spot size may create a mark having a depth of about 60 μm at a scan speed of about 125 mm/sec. While the laser energy in wavelengths that are not absorbed by water may not be attenuated by the presence of moisture in the polishing pad 120, the polyurethane pad material may cause a cooling effect with respect to the laser energy emitted thereon, which reduces the depth of the mark by about 20%-50%.

Figure 4:
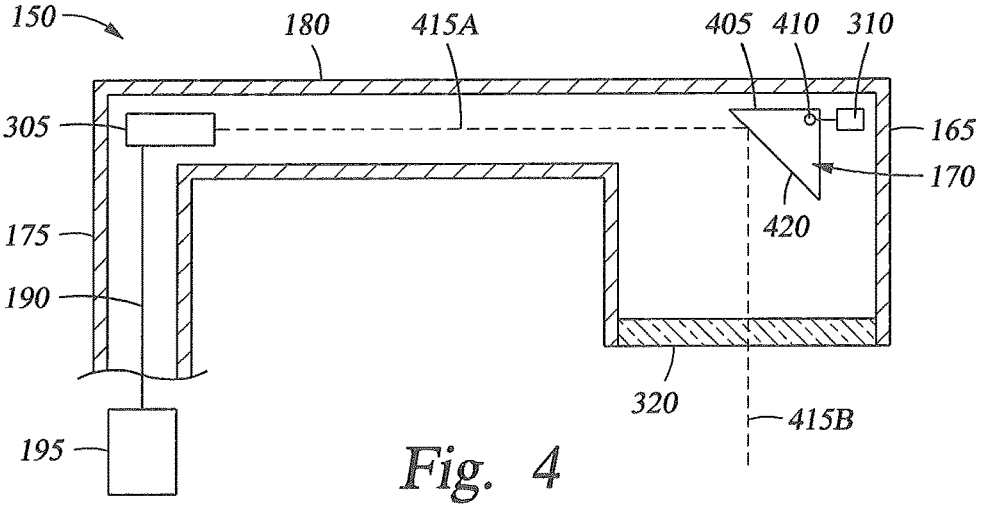
FIG. 4 is a schematic cross-sectional view of a conditioning device having another embodiment of an optical device disposed in the conditioner head.

FIG. 4 is a schematic cross-sectional view of a conditioning device 150 having another embodiment of an optical device 170 disposed in the conditioner head 165. The optical device 170 in this embodiment is a reflective component 405 that is aligned with a laser emitter 305 disposed in one of the support member 175 and the support arm 180. The reflective component 405 may be a mirror, or a scanning galvo-mirror that rotates about an axis 410 extending normally from the plane of FIG. 4. The laser emitter 305 is adapted to emit a primary beam 415A that impinges a surface 420 of the reflective component 405. The surface 420 of the reflective component 405 is adapted to redirect the primary beam 415A and direct a secondary beam 415B toward and against the polishing pad 120 (similar to the embodiment shown in FIG. 1). The surface 420 of the reflective component 405 may include a single facet or multiple facets that are utilized to redirect the secondary beam 415B in multiple angles. The reflective component 405 may be moved by the actuator 310 or the actuator 185 (similar to the embodiment shown in FIG. 1) to scan the secondary beam 415B at a speed of about 1.5 cm/sec to about 500 cm/sec. In one embodiment, the reflective component 405 may be moved by the actuator 310 or the actuator 185 to scan the secondary beam 415B at a speed of about 50 mm/sec to about 1,500 mm/sec. The axis 410 may be in the Z-X plane, the Z-Y plane, the X-Y plane, and combinations thereof. The laser emitter 305 is adapted to emit a continuous or pulsed primary beam 415A and the secondary beam 415B impinges the polishing pad 120 to form groove patterns shown and described in FIGS. 2A and 2B. In one aspect, the secondary beam 415B is provided in a wavelength range that is substantially non-reactive with a polishing fluid utilized in the polishing process but is reactive with the polishing pad material in order to form groove patterns shown and described in FIGS. 2A and 2B. In another aspect, the secondary beam 415B is provided in a wavelength range that is absorbed by polishing pad material in preference to the polishing fluid utilized in the polishing process in order to form the mark and/or groove patterns described in FIGS. 2A and 2B.

Figure 5:
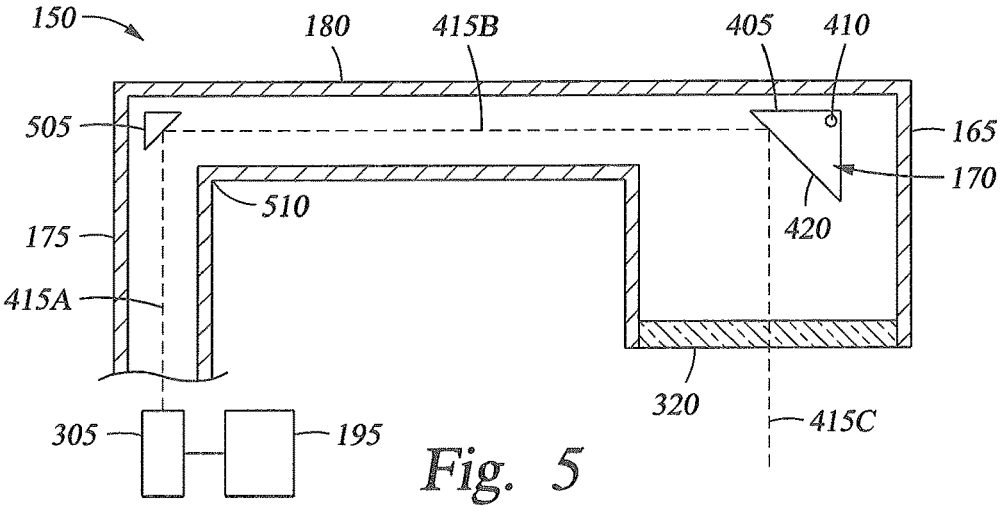
FIG. 5 is a schematic cross-sectional view of a conditioning device having another embodiment of an optical device disposed in the conditioner head.

FIG. 5 is a schematic cross-sectional view of a conditioning device 150 having another embodiment of an optical device 170 disposed in the conditioner head 165. Similar to the conditioning device shown in FIG. 4, the optical device 170 in this embodiment is a reflective component 405. However, the laser emitter 305 is disposed external to the support member 175, and a reflective component 505 is disposed at a junction 510 of the support member 175 defined at the connection between the support member 175 and the support arm 180. The reflective component 505 may be similar to the reflective component 405. The reflective component 505 may be a first mirror configured to redirect a primary beam 415A generated by the laser emitter 305 as a secondary beam 415B directed towards the reflective component 405. Similarly, the reflective component 405 may be a second mirror configured to redirect the secondary beam 415B as a tertiary beam 415C toward and against the polishing pad 120 (similar to the embodiment shown in FIG. 1). The laser emitter 305 is adapted to emit a continuous or pulsed primary beam 415A and the tertiary beam 415C impinges the polishing pad 120 to form groove patterns shown and described in FIGS. 2A and 2B. In one aspect, the tertiary beam 415C is provided in a wavelength range that is substantially non-reactive with a polishing fluid utilized in the polishing process but is reactive with the polishing pad material in order to form groove patterns shown and described in FIGS. 2A and 2B. In another aspect, the tertiary beam 415C is provided in a wavelength range that is absorbed by polishing pad material in preference to the polishing fluid utilized in the polishing process in order to form mark and/or groove patterns shown and described in FIGS. 2A and 2B.

Figure 6:
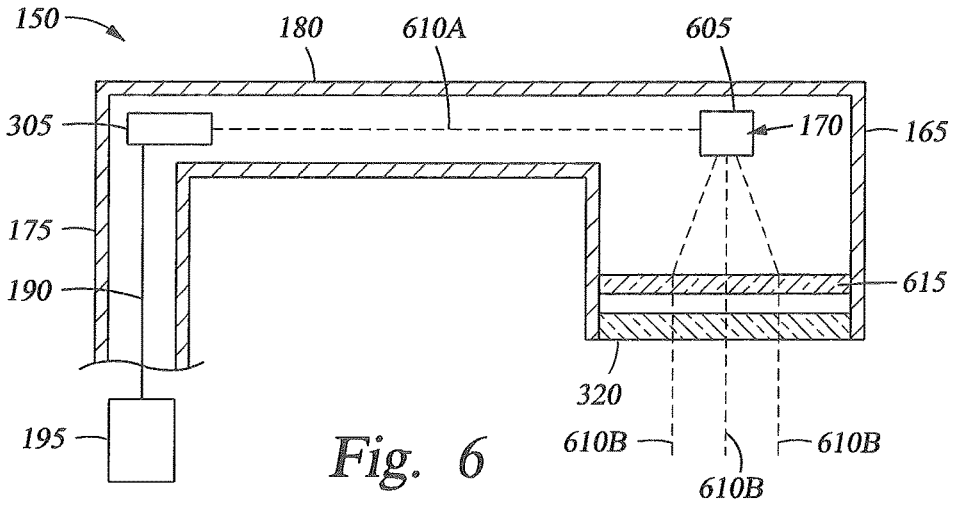
FIG. 6 is a schematic cross-sectional view of a conditioning device having another embodiment of an optical device disposed in the conditioner head.

FIG. 6 is a schematic cross-sectional view of a conditioning device 150 having another embodiment of an optical device 170 disposed in the conditioner head 165. In this embodiment, the optical device 170 comprises a beam splitter 605. The beam splitter 605 is used to receive a primary beam 610A from the laser emitter 305 and transmit two or more secondary beams, shown as 610B, toward a polishing pad 120 (similar to the embodiment shown in FIG. 1). The laser emitter 305 is adapted to emit a continuous or pulsed primary beam 610A and the two or more secondary beams 610B impinge the polishing pad 120 to form groove patterns shown and described in FIGS. 2A and 2B. In one aspect, the two or more secondary beams 610B are provided in a wavelength range that is substantially non-reactive with a polishing fluid utilized in the polishing process but is reactive with the polishing pad material in order to form groove patterns shown and described in FIGS. 2A and 2B. In another aspect, the two or more secondary beams 610B are provided in a wavelength range that is absorbed by polishing pad material in preference to the polishing fluid utilized in the polishing process in order to form mark and/or groove patterns shown and described in FIGS. 2A and 2B.

The two or more secondary beams 610B may exit the beam splitter 605 at various angles and impinge a plane of the polishing pad 120 at non-normal angles. Alternatively, a collimator 615 may be used to redirect the two or more secondary beams 610B to be substantially parallel and spaced apart prior to impingement of the beams onto the polishing pad 120. Using the collimator 615 provides two or more secondary beams 610B impinging the plane of the polishing pad 120 at a substantially normal angle. In this manner, multiple spaced apart groove patterns may be formed on the polishing pad 120 simultaneously.

Figure 7:
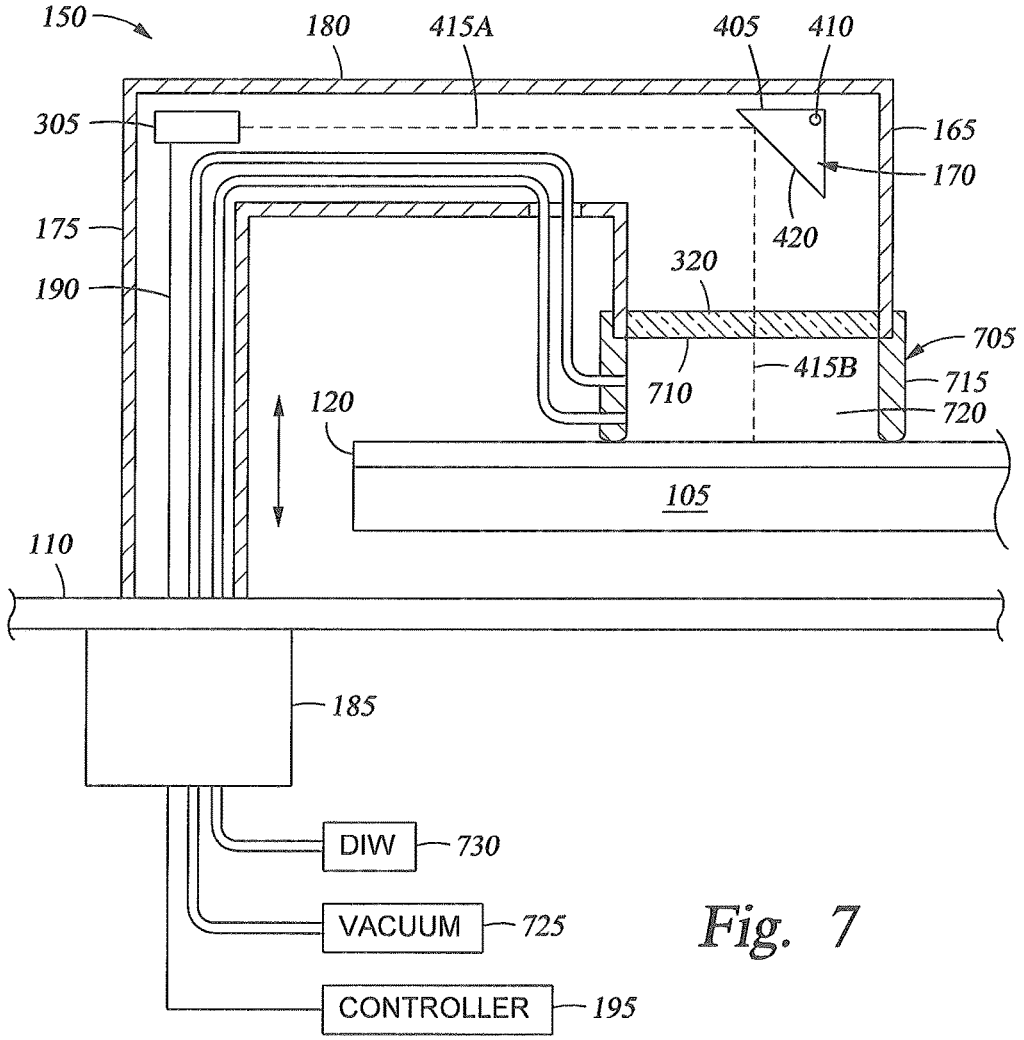
FIG. 7 is a schematic cross-sectional view of another embodiment of a conditioning device.

FIG. 7 is a schematic cross-sectional view of another embodiment of a conditioning device 150. In this embodiment, the optical device 170 is a reflective component 405 similar to the embodiment described in FIG. 4. However, in this embodiment, a housing 705 is coupled to a beam emission side (e.g., lower side) 710 of the conditioner head 165. The housing 705 includes a skirt 715 that define an interior volume 720 below the housing 705. The skirt 715 extends very close to, or is in contact with, the polishing pad 120. The skirt 715 is utilized to contain debris that may be generated by the beam emitted by the laser emitter 305, which is the secondary beam 415B in this embodiment. The interior volume 720 is in fluid communication with a vacuum source 725 to facilitate removal of debris from the interior volume 720, for example, through the skirt 715. Additionally, the interior volume 720 may be coupled with a fluid source 730, such as DIW that is flowed into the housing 705, for example, through the skirt 715. The DIW may be used to entrain debris and assist in removal thereof by the vacuum source. Although not shown, the embodiments of the optical devices 170 shown in FIGS. 1-2 and FIGS. 5-6 may be used with the housing 705 as described herein.

In one embodiment, the housing 705 is urged against the processing surface 125 of the polishing pad 120 at a first downforce value configured to provide a substantial seal between the skirt 715 and the polishing pad 120. In another embodiment, the housing 705 is urged at a second downforce value that is greater than the first downforce value to provide substantial friction between the skirt 715 and the polishing pad 120. In this embodiment, the housing 705 is used to generate heat from friction between the contacting surfaces, which raises the temperature of the processing surface 125 of the polishing pad 120. The elevated temperature of the processing surface 125 of the polishing pad 120 facilitates an improved removal rate of material from a substrate (shown in FIG. 1) during processing. The skirt 715 of the housing 705 may be made of thermoplastic materials, such as a polyetheretherketone (PEEK) material, a polypheneline sulfide (PPS) material, or other suitable polymeric material.

Figure 8:
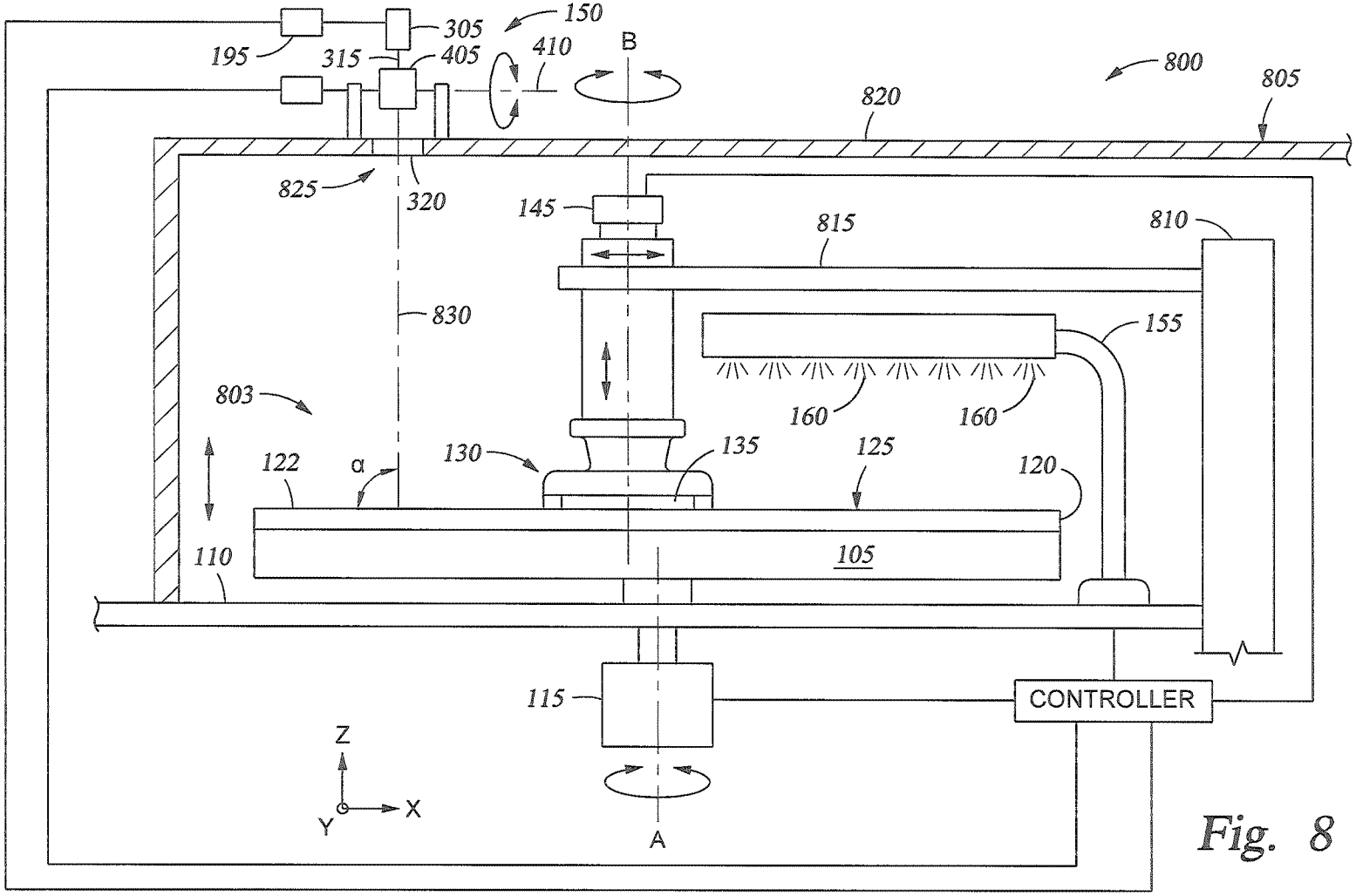
FIG. 8 is a partial sectional view of a processing platform showing another embodiment of a conditioning device.

FIG. 8 is a partial sectional view of another embodiment of a processing platform 800 that is configured to perform a polishing process, such as a CMP process or an electrochemical mechanical polishing ECMP process. The processing platform 800 shown in FIG. 8 shows a processing station 803 that may be similar to the processing station 100 of FIG. 1. However, the processing station 803 may be a stand-alone tool or part of a larger polishing system. The components of the processing station 803 are similar to the components of the processing station 100 of FIG. 1 with the exception of an enclosure 805 disposed at least partially around the polishing station 803 and a modified support system for the carrier head 130. The processing station 803 includes the platen 105 supporting the polishing pad 120, the carrier head 130 and the fluid applicator 155, as well as drive and control systems common between the processing station 803 and the processing station 100 of FIG. 1. Additionally, in this embodiment, the processing platform 800 includes another embodiment of a conditioning device 150. The processing platform 800 may have multiple processing stations (not shown) that are similar to the processing station 803 shown in FIG. 8. All components of the processing platform 800 that are similar to the components of the processing station 100 of FIG. 1 will not be repeated for brevity.

In this embodiment, the carrier head 130 is supported by a support member 810 that is positioned laterally relative to the polishing pad 120. A support arm 815 is coupled to the support member 810. While the support member 810 and the support arm 815 are shown supporting the carrier head 130 above the polishing pad 120, the support member 810 may form a portion of a caroussel device that supports multiple carrier heads (not shown) disposed above multiple platens and polishing pads (both not shown). In this embodiment, the carrier head 130 may be configured to move laterally relative to the support arm 815 in an oscillating pattern (i.e., in the X and Y axes) to produce the sweep pattern 215 (shown in FIG. 2A) on the polishing pad 120.

In this embodiment, the conditioning device 150 is positioned above the processing surface 125 of the polishing pad 120, and is supported by a ceiling 820 of the enclosure 805. The conditioning device 150 includes the laser emitter 305 and the signal generator 195 disposed adjacent an opening 825 formed through the ceiling 820. The opening 825 may include the window 320 that is utilized to prevent any polishing debris from exiting the enclosure 805. The laser emitter 305 is adapted to emit a primary beam 315 that may be directed through the window 320 toward the processing surface 125 of the polishing pad 120 or, alternatively, toward a reflective component 405, to provide a secondary beam 830 that impinges the polishing pad 120 to form groove patterns shown and described in FIGS. 2A and 2B. The reflective component 405 may be a mirror, such as a scanning mirror or a scanning galvo-mirror that is coupled to an actuator 310 to move the reflective component 405 about the axis 410 (about the X axis). In another embodiment, the reflective component 405 may be configured to rotate about the Y axis (to change the angle $\alpha$ relative to the processing surface 125 of the polishing pad 120) as an alternative to, or in addition to, the movement about the axis 410.

Forming groove patterns on polishing pads using laser devices has been used in the manufacture of new polishing pads. In this function, the pad material is generally moisture-free, and lasers with relatively high absorption coefficients are used. Carbon dioxide ($CO_2$) laser devices with wavelengths of about 10.6 μm (e.g., far infrared spectrum) may be utilized for grooving patterns in this liquid-free medium. However, during conditioning a polishing pad during substrate polishing, the polishing pad is wetted in a polishing fluid or slurry, of which water is a main constituent. The use of laser devices having wavelengths that are readily absorbed by the polishing fluid (e.g., water), such as 10.6 μm, creates challenges. When the optical energy is absorbed by water in the pad material, heating of the water ensues. The heating of the water may cause the water to boil. As the pad material is generally porous, the boiling of water in pores, or localized areas of pores, may cause ruptures in the pad surface. This rupturing is generally uncontrollable across different areas of the pad surface, and may produce large asperities, as well as a non-uniform grooving pattern across the polishing surface.

Conditioning of a polishing pad 120 utilizing optical devices 170 as described herein may utilize optical energy in wavelengths that are not readily absorbed by a polishing medium (e.g., polishing fluid or slurry) but are absorbed efficiently by the pad material. Thus, a direct ablation of the pad material may be realized without the problems encountered from moisture in the pad material, and a controllable groove pattern may be formed in the processing surface 125 of the polishing pad 120 as described herein.

Figure 9:
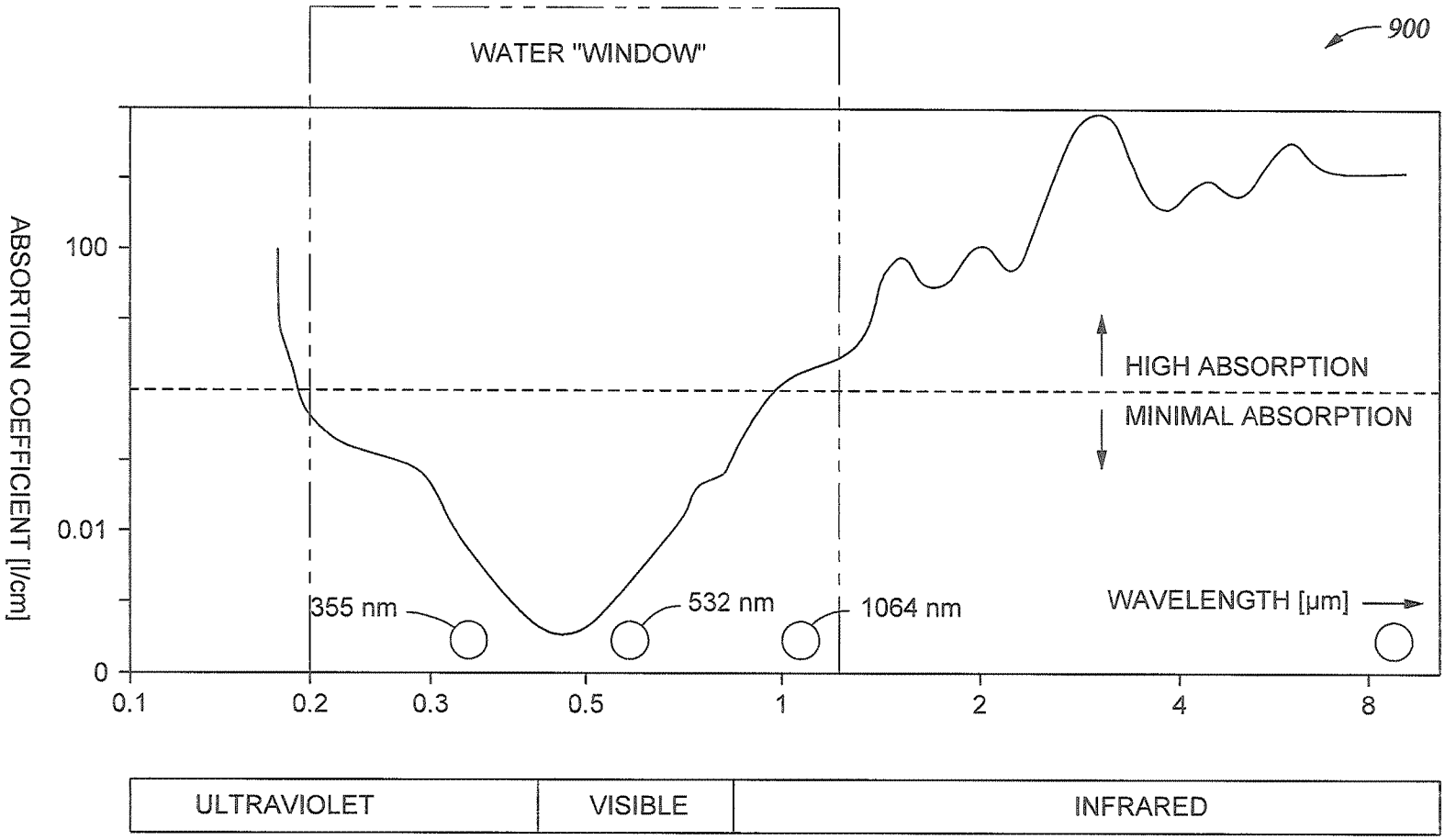
FIG. 9 is a graph showing absorption coefficients for various wavelengths of light.

FIG. 9 is a graph 900 showing absorption coefficients (1/centimeter (cm) or $cm^{-1}$) for various wavelengths. A "water window" is interposed on the graph 900. Wavelengths in between about 200 nanometers (nm) and about 1,200 nm show a low absorption coefficient (less than about 1.0/cm) while wavelengths above 1,200 nm have a high absorption coefficient (greater than about 100/cm). Thus, laser devices, such as the laser emitter 305 described in FIGS. 3-8), having wavelength ranges within the "water window" are utilized with the conditioning devices 150 as shown in FIGS. 3-8. Examples of suitable wavelengths for the laser emitter 305 include ultraviolet wavelength ranges (e.g., about 355 nm), visible wavelength ranges (e.g., about 532 nm), near infrared wavelength ranges (e.g., about 1064 nm), and combinations thereof. In one embodiment, the absorption coefficient of the material of the polishing pad 120 is greater than about 1.0/cm, such as about 5.0/cm, or greater, while the absorption coefficient of the polishing fluid is less than about 1.0/cm, such as about 0.5/cm. In one aspect, the wavelengths of the laser emitter 305 are substantially transparent (non-reactive) with the water-based polishing fluid. "Substantially transparent" may be defined as the incapability of the beam to cause a phase change of the polishing fluid under normal operating conditions (i.e., wavelength range of the beam, output power of the beam, spot size of the beam, dwell time of the beam on the polishing pad material, and combinations thereof). "Substantially transparent" may also be defined as the incapability of the beam to cause the polishing fluid to heat up and/or boil under normal use in the conditioning process as described herein. For example, the wavelengths of the laser emitter 305 as described herein would not cause a substantial rise in temperature of the polishing fluid under normal operating conditions using a pulsed beam and/or short dwell times. In another aspect, the wavelength ranges provided by the laser emitter 305 are substantially non-reactive with a polishing fluid utilized in the polishing process but is reactive with the polishing pad material in order to form groove patterns shown and described in FIGS. 2A and 2B. In another aspect, the wavelength ranges provided by the laser emitter 305 are absorbed by polishing pad material in preference to the polishing fluid utilized in the polishing process in order to form mark and/or groove patterns shown and described in FIGS. 2A and 2B.

Embodiments of a conditioning device 150 are provided. The conditioning devices 150 include a laser emitter 305 that forms patterns of grooves, or discrete holes or channels, on a surface of a polishing pad 120. The laser emitter 305 is provided at a wavelength that is preferentially absorbed by the material of the polishing pad 120 as opposed to the polishing fluid that is used during a polishing process. The conditioning devices 150 form patterns of grooves or holes with controlled depths and/or dimensions (length and/or width) with reduced pad debris, which results in lower defect rates, longer pad lifetime, as well as improving removal rate.

While the foregoing is directed to embodiments of the invention, other and further embodiments of the invention may be devised without departing from the basic scope thereof.

What is claimed is:

1. A pad conditioning device for a substrate polishing process, the pad conditioning device comprising:

an optical device coupled to a portion of a polishing station adjacent a polishing pad, the optical device comprising a laser emitter adapted to emit a beam toward a polishing surface of the polishing pad, the beam having a wavelength range that is substantially non-reactive with a polishing fluid utilized in the polishing process, but is reactive with the polishing pad.

2. The device of claim 1, wherein the optical device is coupled to an enclosure disposed about the polishing station.

3. The device of claim 2, wherein the optical device comprises a reflective component disposed between the laser emitter and the polishing surface of the polishing pad.

4. The device of claim 3, wherein one of the reflective component is coupled to an actuator to move the reflective component relative to the beam.

5. The device of claim 1, wherein the optical device is coupled to a conditioning arm disposed on the polishing station.

6. The device of claim 5, wherein the conditioning arm includes a conditioning head coupled to the conditioning arm.

7. The device of claim 6, wherein the optical device comprises one or more reflective components disposed in one or both of the conditioner head and the arm.

8. The device of claim 7, wherein one of the one or more reflective components is coupled to an actuator disposed in the pad conditioning device.

9. The device of claim 6, further comprising:

a skirt coupled to the conditioner head.

10. The device of claim 9, wherein an interior volume defined by the skirt is coupled to one or both of a vacuum source and a fluid source.

11. An apparatus for polishing a substrate, comprising:

a base having a rotatable platen and a polishing pad coupled to an upper surface thereof; and a conditioning device positioned adjacent the rotatable platen, the conditioning device adapted to emit and move an incident beam relative to a polishing surface of the polishing pad, wherein the conditioning device comprises an optical device, the optical device comprising a laser emitter adapted to emit a beam having a wavelength range that is not absorbed by a polishing fluid utilized on the polishing pad but is reactive with a material of the polishing pad.

12. The apparatus of claim 11, further comprising:

an enclosure that at least partially contains the platen and the polishing pad therein, wherein the conditioning device is coupled to the enclosure.

13. The apparatus of claim 12, wherein the conditioner device comprises a micromechanical device to scan the incident beam across the polishing surface of polishing pad.

14. The apparatus of claim 12, wherein the optical device comprises one or more reflective components disposed between the laser emitter and the polishing surface of the polishing pad.

15. The apparatus of claim 11, wherein the conditioner device is coupled to the base and comprises a conditioner head coupled to an arm.

16. The apparatus of claim 15 wherein the conditioner head comprises a micromechanical device to scan the incident beam across the surface of polishing pad.

17. The apparatus of claim 15, wherein the optical device comprises one or more reflective components disposed in one or both of the conditioner head and the arm.

18. A method for conditioning a polishing pad, comprising:

rotating a polishing pad having a polishing fluid disposed thereon; and conditioning a polishing surface of the polishing pad by scanning the polishing surface with a laser beam to form a groove pattern in the polishing surface, wherein the laser beam has a wavelength that is substantially transparent to the polishing fluid, but is reactive with the material of the polishing pad.

19. The method of claim 18, wherein the wavelength is in the near-infrared spectrum, the visible spectrum, or the ultraviolet spectrum.

20. The method of claim 18, wherein the laser beam is emitted from a conditioner head, and the conditioner head is moved in a sweep pattern relative to the polishing pad.

21. The method of claim 18, wherein the laser beam is emitted from a stationary conditioner head and a micromechanical device disposed in the conditioner head scans the beam across the pad.

* * * * *